US006179592B1

(12) United States Patent
Hugenroth et al.

(10) Patent No.: US 6,179,592 B1
(45) Date of Patent: Jan. 30, 2001

(54) REVERSE ROTATION FLANK SEPARATOR FOR A SCROLL COMPRESSOR

(75) Inventors: Jason J. Hugenroth, Hope; Thomas R. Barito, Arkadelphia, both of AR (US)

(73) Assignee: Scroll Technologies, Arkadelphia, AR (US)

( * ) Notice: Under 35 U.S.C. 154(b), the term of this patent shall be extended for 0 days.

(21) Appl. No.: 09/310,545

(22) Filed: May 12, 1999

(51) Int. Cl.[7] ..... F04C 18/04
(52) U.S. Cl. ..... 418/55.5; 418/57
(58) Field of Search ..... 418/55.5, 57

(56) References Cited

U.S. PATENT DOCUMENTS

| | | | | |
|---|---|---|---|---|
| 5,017,207 | | 5/1991 | Fraser, Jr. et al. | 418/55.5 |
| 5,174,739 | * | 12/1992 | Kim | 418/55.5 |
| 5,433,589 | | 7/1995 | Wada et al. | 418/55.5 |
| 5,447,419 | | 9/1995 | Wada et al. | 418/55.5 |
| 5,496,157 | | 3/1996 | Shoulders et al. | 418/55.5 |
| 5,496,158 | | 3/1996 | Barito et al. | 418/55.5 |
| 5,545,019 | | 8/1996 | Beck et al. | 418/55.1 |
| 5,772,415 | | 6/1998 | Monnier et al. | 418/55.5 |

FOREIGN PATENT DOCUMENTS

| | | | | |
|---|---|---|---|---|
| 0840011A1 | | 6/1998 | (EP) . | |
| 5-248371 | * | 9/1993 | (JP) | 418/55.5 |
| WO 9946506 | | 9/1999 | (WO) . | |

* cited by examiner

*Primary Examiner*—John J. Vrablik
(74) *Attorney, Agent, or Firm*—Carlson, Gaskey & Olds

(57) ABSTRACT

A scroll compressor is provided with structure that causes the wraps to move out of engagement when reverse rotation occurs. An eccentric pin and slider block are constructed such that when forward rotation is occurring, flat surfaces on the pin and slider block are brought into contact to drive the slider block and hold the wraps in engagement. However, when reverse rotation occurs, the flat surfaces move out of engagement. The slider block has a pivot point which moves into contact with the eccentric pin. The slider block pivots relative to the eccentric pin, and the wraps of the scroll members are brought out of engagement.

16 Claims, 3 Drawing Sheets

REVERSE ROTATION FLANK SEPARATOR FOR A SCROLL COMPRESSOR

BACKGROUND OF THE INVENTION

This invention relates to a system which moves the flanks of a scroll compressor out of engagement when reverse rotation occurs.

Scroll compressors are becoming widely utilized in refrigerant compression applications. Scroll compressors typically include two scroll members each including a base and a generally spiral wrap extending from the base. The two wraps interfit to define a plurality of compression chambers. A refrigerant is trapped in the chambers, and one of the two scroll members orbits relative to the other to reduce the size of the compression chambers. When this occurs, the refrigerant is compressed.

One early challenge in the design of scroll compressors was to achieve a good seal between the flanks of the scroll wrap when they define the compression chambers. Various mechanisms were developed for moving the flanks into engagement to define the compression chambers. Among the components of the standard scroll compressors which allow the orbiting movement, and further allow the flanks to move into engagement is an eccentric pin mounted on the driving shaft which is received in a slider block in a boss extending from the base of the orbiting scroll member.

One problem associated with scroll compressors is reverse rotation. With reverse rotation, the orbiting scroll member is driven in a reverse direction. This can occur if the motor is improperly connected, or upon shut down of the scroll compressor. In some cases, at shut down, an entrapped compressed refrigerant drives the orbiting scroll member in an opposed direction. Reverse rotation is undesirable.

Various mechanisms have been developed to move the scroll members out of engagement when reverse rotation occurs. Generally, these mechanisms have been complex, and not always reliable. Thus, it would be desirable to develop a relatively simply and reliable mechanism for moving the flanks of the scroll wraps out of engagement upon the occurrence of reverse rotation.

SUMMARY OF THE INVENTION

In a disclosed embodiment of this invention, structure is provided between the eccentric pin and the slider block in an orbiting scroll that causes the slider block to rotate relative to the eccentric pin when reverse rotation occurs. Essentially, the forces on the slider block can be defined, and the slider block and eccentric pin designed such that when the scroll compressor is orbiting in the proper forward direction, two flat surfaces of the pin and slider block are in engagement for transmitting driving force. This also holds the flanks of the wraps in engagement.

However, when reverse rotation occurs, a separating force which had been less than a holding force during forward rotation becomes predominant and exceeds the holding force. The separating force thus causes the slider block to move to a position such that the flat surfaces are out of engagement. After a small amount of initial movement a pivot point between the slider block and eccentric pin moves into engagement. After that initial movement, the slider block pivots relative to the eccentric pin, and the flanks of the scroll wrap are held out of contact with each other. Thus, should reverse rotation begin, the flanks are moved out of engagement. If this reverse rotation is due to faulty wiring, there would be no detrimental side effects of the reverse rotation since little compression will occur.

In one embodiment, the pivot point is defined by a plug protruding from an inner bore in the slider block into a recess in the eccentric pin. In a second embodiment, the pivot point is defined by a plug surface which moves into contact with an outer surface of the eccentric pin, but not into any groove. In a third embodiment, a separate pin on the shaft moves into a groove in the slider block.

These and other features of the present invention can be best understood from the following specification and drawings, the following which is a brief description.

DETAILED DESCRIPTION OF A PREFERRED EMBODIMENT

Figure 1A:
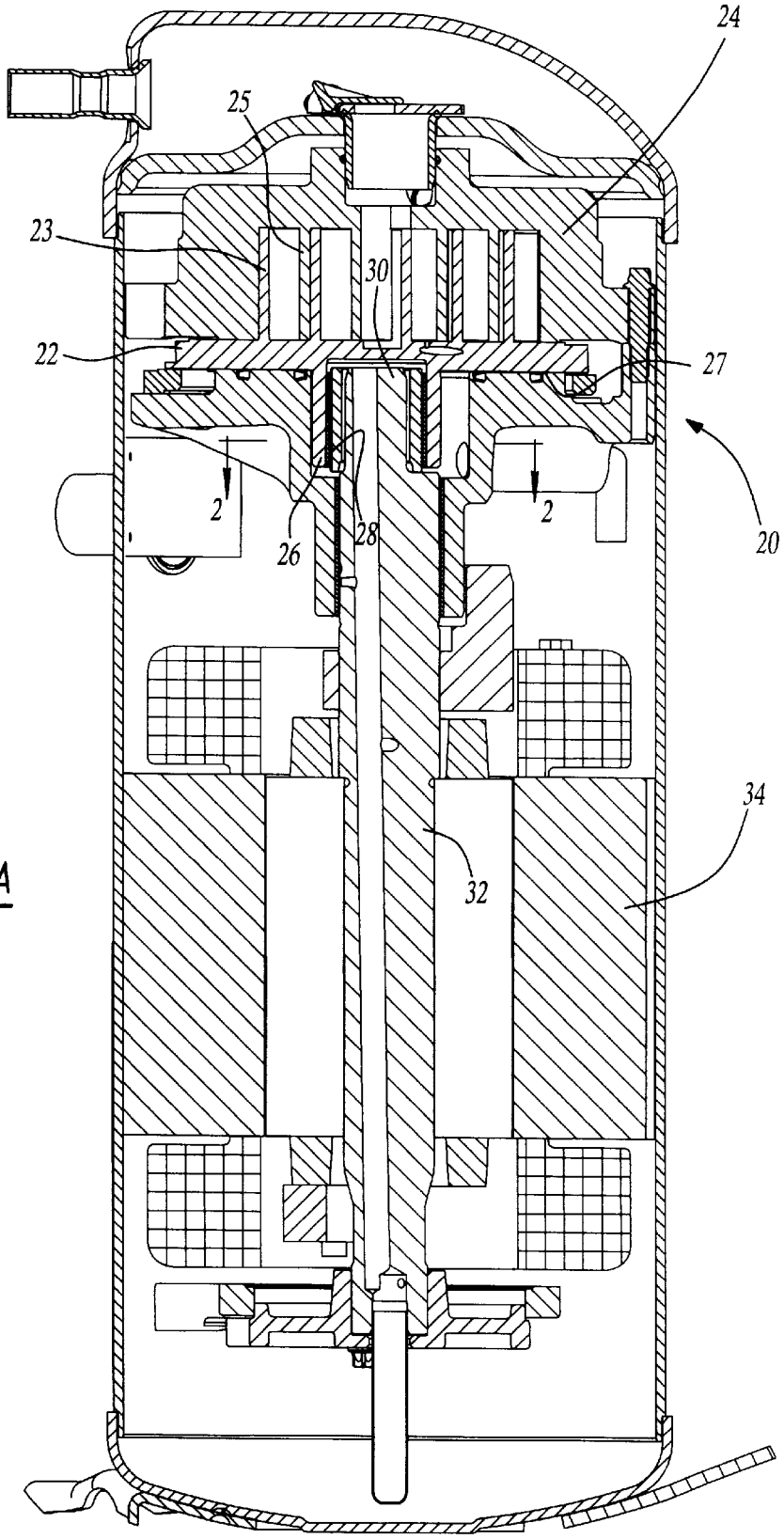
FIG. 1A is a cross-sectional view showing a scroll compressor.

A scroll compressor 20 is illustrated in FIG. 1A having an orbiting scroll 22 with a wrap 23 extending toward a non-orbiting scroll 24. The wrap 23 interfits with a wrap 25 on the non-orbiting scroll 24.

A neck or boss 26 extends downwardly from a base 27 of the orbiting scroll 22, and receives a slider block 28. An eccentric pin 30 extends upwardly into the slider block 28 from a shaft 32. An electric motor 34 drive shaft 32, as known.

Figure 1B:
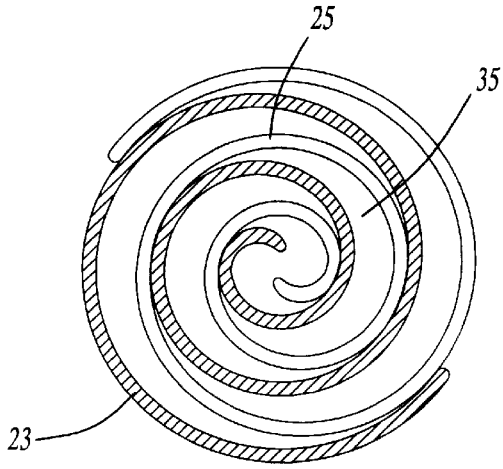
FIG. 1B shows the wraps of the scroll compressor in an engaged position.
Figure 1C:
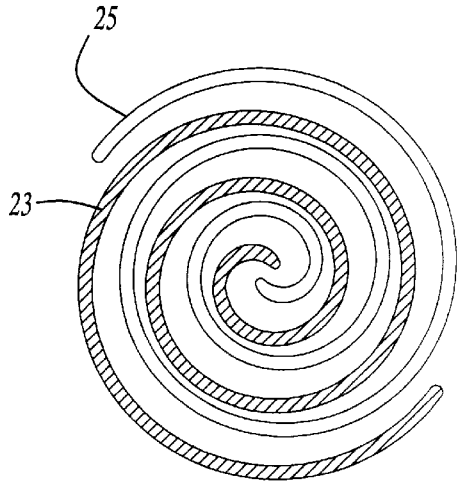
FIG. 1C shows the wraps moved out of engagement.

As shown in FIG. 1B, the wraps 23 and 25 are held in engagement to define compression chambers such as chambers 35. However, as shown in FIG. 1C, with the present invention, the wraps are moved out of engagement such that compression chambers are not defined when reverse rotation occurs. As explained above, this will reduce the detrimental effect of reverse rotation.

Figure 2A:
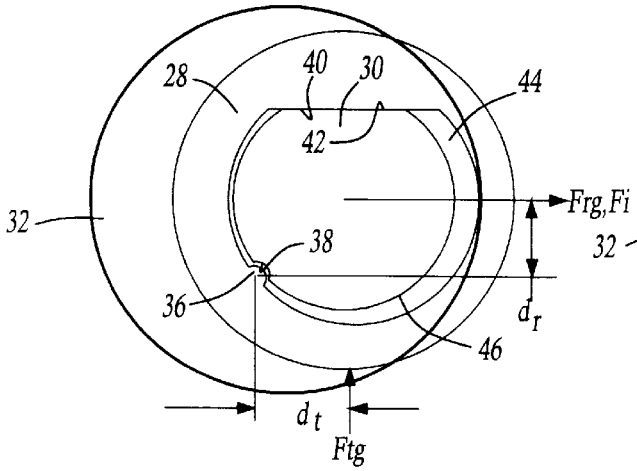
FIG. 2A shows a first embodiment mechanism for moving the scroll wraps between the positions of FIG. 1B and 1C depending on the direction of rotation.

An embodiment of the present invention is shown in FIG. 2A. Eccentric pin 30 includes a surface 42 which engages a flat surface 40 on an inner bore of the slider block 28 when forward rotation occurs. The outer diameter of the slider block 28 is closely received in the boss 26 such that rotation of the slider block is effectively equal to the motion of the orbiting scroll 22. As shown, the inner bore of the slider block 28 includes a part circular portion 44 extending from both ends of the flat surface 40. The eccentric pin also has a part circular surface 46. A pivot point 36 protrudes from the inner bore portion 44 and is selectively received within a groove 38 in the surface 46.

In the position shown in FIG. 2A, the compressor is held in the FIG. 1B position. Drive is transmitted between surface 42 to surface 40. As shown, when reverse rotation occurs a tangential gas force $F_{tg}$ is applied to the slider block at a position $d_t$ away from the pivot point 36. A second radial gas force $F_{rg}$ and a centrifugal force $F_i$ are applied a distance $d_r$ away from the center point. During forward running, slider block portion 36 is not in engagement with recess 38 on the eccentric pin. The slider block 28 will be held in the illustrated position.

However, during reverse rotation, the moment $F_{tg} \times d_t$ exceeds the moment $(F_i+F_{rg})\times d_r$. Essentially, the separating force exceeds the holding force.

Figure 2B:
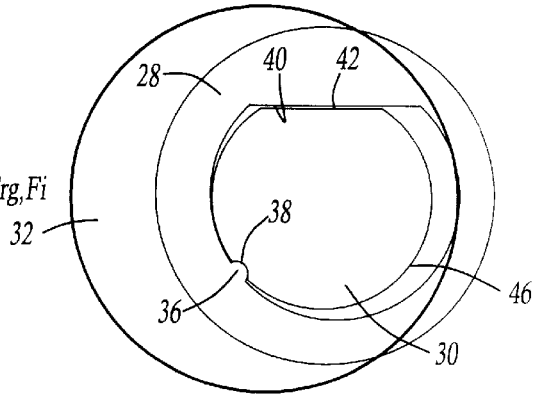
FIG. 2B shows the FIG. 2A embodiment in a subsequent position.
Figure 2C:
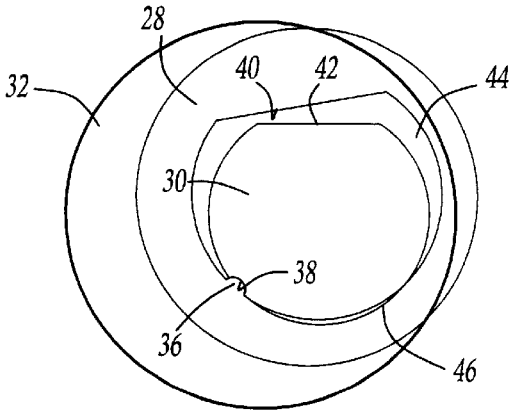
FIG. 2C shows the FIG. 2A embodiment in yet another subsequent position.

Initially, the force change causes the slider block to move slightly upwardly and to the right from the position shown in FIG. 2A to the position shown in FIG. 2B. The pivot point 36 is now bottomed out in groove 38. In this position, the surfaces 40 and 42 are out of engagement. Thus, the flanks of the scroll wraps are no longer necessarily held in contact. With reverse rotation, the force $F_{tg} \times d_t$ continues to cause the slider block to move. From the position shown in FIG. 2B, the slider block quickly pivots to the position shown in FIG. 2C. In this position, the wraps of the scroll members 23 and 25 are held out of engagement and in the FIG. 1C position. Thus, the present invention provides a very simple mechanism for ensuring that the wraps move out of engagement quickly and certainly upon the occurrence of reverse rotation.

Figure 3A:
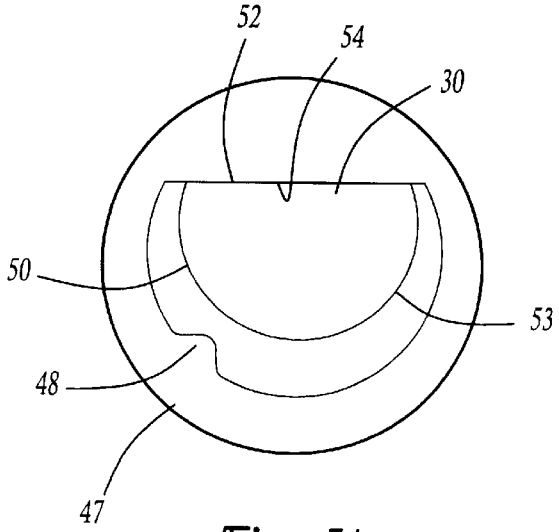
FIG. 3A shows a second embodiment in the drive position.

FIG. 3A shows another embodiment with eccentric pin 50 having a flat surface 52 and a curved surface 53. A slider block 47 includes a pin portion 48 which selectively contacts the surface 53 of the pin 50. As shown, pin portion 48 is preferably curved. In the position shown in FIG. 3A, the separating force again is less than the holding forces and the surface 52 is held in contact with flat surface 54 on block 47. Drive is transmitted as normally occurs.

However, when reverse rotation occurs, the holding force is exceeded by the separating force. The slider block 47 then moves to the position such as shown in FIG. 3B, wherein the pin 48 contacts the outer surface 50 of the eccentric pin 30.

Figure 3B:
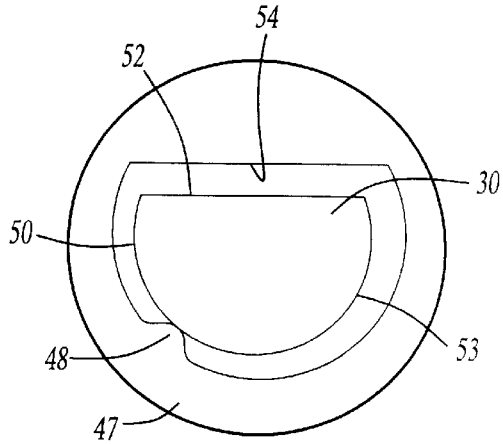
FIG. 3B shows a position subsequent to the FIG. 3A position.
Figure 3C:
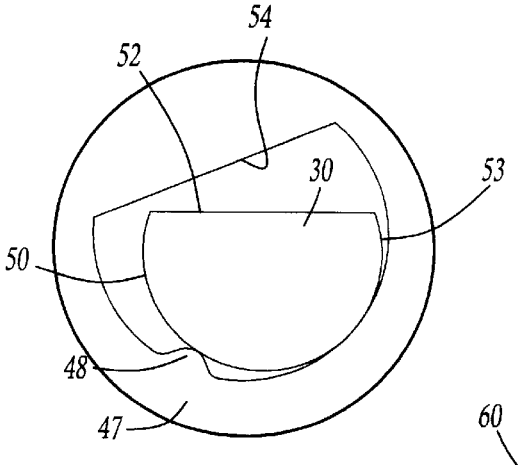
FIG. 3C shows yet another subsequent position.

With further reverse rotation from the position shown in FIG. 3B, slider block 47 will quickly pivot to the position shown in FIG. 3C. Again, in the position shown in FIGS. 3B and 3C, the flanks of the scroll wraps are held out of engagement in the FIG. 1C position. Thus, the detrimental effect of reverse rotation is reduced.

Figure 4:
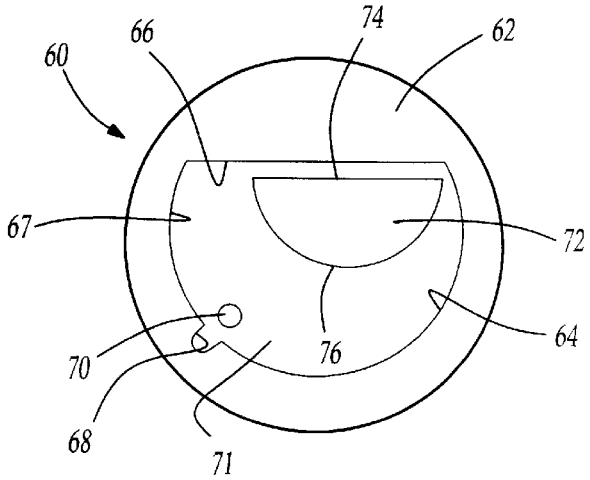
FIG. 4 shows another embodiment.

As shown in FIG. 4, a third embodiment 60 incorporates the slider block 62 having an opening 64. The opening 64 includes a flat portion 66 and a curved portion 67. A groove 68 extends into the slider block 62 from the curved portion 67. A separate pin 70 is formed as part of the rotating shaft 71. An eccentric pin 72 is also formed as part of the shaft 71. Eccentric pin 72 has a flat surface 74 and a curved portion 76. As in the prior embodiments during forward rotation, a flat surface 74 is brought into contact with the flat surface 66 and drive is transmitted. However, upon reverse rotation, the slider block 62 will initially move such that groove 68 moves onto pin 70. The pivot point is then set and the slider block 62 will then pivot relative on the pin 70 and relative to the eccentric pin 72. This brings the wraps to the FIG. 1C position.

Although preferred embodiments of this invention have been disclosed, a worker in this art would recognize that several modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from said base, said wraps of said first and second scroll members interfitting to define compression chambers, said second scroll member having a downwardly extending boss with a bore, and a slider block received in said bore in said boss;

said slider block having an internal bore, said slider block being connected to move with said second scroll member;

a drive shaft for driving said second scroll member to orbit relative to said first scroll member, said drive shaft including an eccentric pin extending upwardly into said slider block bore, and said eccentric pin selectively driving said slider block, and thus said second scroll member to orbit relative to said first scroll member; and said drive shaft and said slider block being configured to have structure to cause movement such that when said shaft rotates in a first direction, a flat surface on said eccentric pin engages a flat surface on said slider block and said wraps of said first and second scroll members are brought into contact with each other to define said compression chambers, and wherein when said shaft rotates in a second direction opposed to said first direction, said flat surfaces move out of engagement, and said slider block is caused to pivot relative to said eccentric pin about a pivot point.

2. A scroll compressor as recited in claim 1, wherein said eccentric pin has said flat surface at one portion and a curved surface at portions other than said flat surface.

3. A scroll compressor as recited in claim 2, wherein said slider block bore includes said flat surface and a curved surface at portions other than said flat surface.

4. A scroll compressor as recited in claim 3, wherein said pivot point is defined by a structure protruding from said curved portion of said slider block bore.

5. A scroll compressor as recited in claim 4, wherein said protruding structure selectively extends into a groove in said curved surface of said eccentric pin.

6. A scroll compressor as recited in claim 4, wherein said protruding structure selectively engages said curved surface of said eccentric pin.

7. A scroll compressor as recited in claim 1, wherein said pivot point is defined by a separate pin spaced from said eccentric pin which also moves with said shaft.

8. A scroll compressor as recited in claim 7, wherein a groove is formed in said slider block which moves onto said separate pin.

9. A scroll compressor comprising:

a first scroll member having a base and a generally spiral wrap extending from said base;

a second scroll member having a base and a generally spiral wrap extending from said base, said wraps of said first and second scroll members interfitting to define compression chambers, said second scroll member having downwardly extending, boss with a bore, and a slider block received in ,said bore in said boss;

said slider block having an internal bore, said slider block being connected to move with said second scroll member;

a drive shaft for driving said second scroll member to orbit relative to said first scroll member, said drive shaft including an eccentlic pin extending upwardly into the slider block bore, and said eccentric pin selectively driving said slider block, and thus said second scroll member to orbit relative to said first scroll member; and said drive shaft and said slider block being configured to have structure to cause movement such that when said shaft rotates in a first direction, a separating force is less than a holding force and a flat surface on said eccentric pin engages a flat surface on said slider block and said wraps of said first and second scroll members are brought into contact with each other to define said compression chambers, and wherein when said shaft rotates in a second direction opposed to said first direction, said separating force exceeds said holding force and said flat surfaces move out of engagement, and said slider block is caused to pivot relative to said eccentric pin about a pivot point.

10. A scroll compressor as recited in claim 9, wherein said eccentric pin has said flat surface at one portion and a curved surface at portions other than said flat surface.

11. A scroll compressor as recited in claim 10, wherein said slider block bore includes said flat surface and a curved surface at portions other than said flat surface.

12. A scroll compressor as recited in claim 11, wherein said pivot point is defined by a structure protruding from said curved portion of said slider block bore.

13. A scroll compressor as recited in claim 12, wherein said protruding structure selectively extends into a groove in said curved surface of said eccentric pin.

14. A scroll compressor as recited in claim 12, wherein said protruding structure selectively engages said curved surface of said eccentric pin.

15. A scroll compressor as recited in claim 9, wherein said pivot point is defined by a separate pin spaced from said eccentric pin which also moves with said shaft.

16. A scroll compressor as recited in claim 15, wherein a groove is formed in said slider block which moves onto said separate pin.

* * * * *